US010751601B2

(12) United States Patent
Han et al.

(10) Patent No.: US 10,751,601 B2
(45) Date of Patent: Aug. 25, 2020

(54) AUTOMATIC RALLY DETECTION AND SCORING

(71) Applicant: BEIJING SHUNYUAN KAIHUA TECHNOLOGY LIMITED, Haidian District, Beijing (CN)

(72) Inventors: Zheng Han, Beijing (CN); Guobin Shen, Beijing (CN); Xiaowei Dai, Beijing (CN)

(73) Assignee: BEIJING SHUNYUAN KAIHUA TECHNOLOGY LIMITED, Beijing (CN)

( * ) Notice: Subject to any disclaimer, the term of this patent is extended or adjusted under 35 U.S.C. 154(b) by 539 days.

(21) Appl. No.: 15/338,010

(22) Filed: Oct. 28, 2016

(65) Prior Publication Data

US 2018/0117440 A1 May 3, 2018

(51) Int. Cl.

| | |
|---|---|
| ***A63B 60/38*** | (2015.01) |
| ***A63B 71/06*** | (2006.01) |
| ***A63B 69/00*** | (2006.01) |
| ***A63B 69/38*** | (2006.01) |
| *A63B 102/04* | (2015.01) |

(52) U.S. Cl.

CPC ..... *A63B 71/0605* (2013.01); *A63B 69/0017* (2013.01); *A63B 69/38* (2013.01); *A63B 71/0686* (2013.01); *A63B 2102/04* (2015.10); *A63B 2220/30* (2013.01); *A63B 2220/833* (2013.01); *A63B 2225/30* (2013.01)

(58) Field of Classification Search

CPC ..... A63B 71/0605; A63B 69/0017; A63B 71/0686; A63B 2220/833; A63B 2225/30; A63B 2102/04; A63B 2220/30

See application file for complete search history.

(56) References Cited

U.S. PATENT DOCUMENTS

| | | | | |
|---|---|---|---|---|
| 5,733,210 A * | 3/1998 | Yiu | ..... | A63B 71/06 473/475 |
| 2007/0105666 A1* | 5/2007 | Fernandez | ..... | A63B 49/00 473/553 |
| 2009/0066641 A1* | 3/2009 | Mahajan | ..... | A63F 13/10 345/156 |

(Continued)

OTHER PUBLICATIONS

Badminton Rules. www.anderson.edu. Online. Aug. 10, 2016. Accessed via the Internet. Accessed Aug. 4, 2018. <URL: https://web.archive.org/web/20160810001834/https://www.anderson.edu/uploads/campus-life/badminton.pdf>.*

*Primary Examiner* — Dmitry Suhol
*Assistant Examiner* — Carl V Larsen
(74) *Attorney, Agent, or Firm* — Young Basile Hanlon & MacFarlane, P.C.

(57) ABSTRACT

Embodiments disclosed provide a solution to detect a rally in a sports game. One or more stroke actions or non-stroke actions are detected based on motion data detected by a sensor attached to a sports instrument of a user. Using a trained stroke classification model, each detected stroke action is classified into a plurality of classes. Additionally, a determination is made whether each detected non-stroke action is an intentional special user action. The determination whether a non-stroke action is an intentional special user action is made based on a customized set of definitions defining one or more special user actions. One or more rallies are then detected based on the classified stroke actions and intentional special user actions.

19 Claims, 11 Drawing Sheets

(56) References Cited

U.S. PATENT DOCUMENTS

| | | | | |
|---|---|---|---|---|
| 2015/0029341 | A1* | 1/2015 | Sinha | H04N 5/772 348/157 |
| 2016/0074739 | A1* | 3/2016 | Pisupati | A63B 71/0669 700/92 |
| 2016/0314352 | A1* | 10/2016 | Matsunaga | G06K 9/00724 |
| 2016/0322078 | A1* | 11/2016 | Bose | G11B 27/031 |
| 2016/0365121 | A1* | 12/2016 | DeCaprio | G11B 27/036 |
| 2017/0011527 | A1* | 1/2017 | Matsunaga | G06K 9/00342 |
| 2017/0072283 | A1* | 3/2017 | Davisson | A61B 5/6895 |
| 2017/0182405 | A1* | 6/2017 | Holmes | A63F 13/211 |

* cited by examiner

AUTOMATIC RALLY DETECTION AND SCORING

BACKGROUND

This disclosure relates generally to sports game tracking and particularly to detecting highlights, e.g., rallies, in a sports game, and automatically scoring the sports game.

Sports such as badminton, tennis, table tennis, squash, etc. are very popular activities, featuring single (i.e., 1 on 1) or double (i.e., 2 on 2) games. One of the challenges in real games is to remember the score by players. In addition, it is increasingly popular that people capture their own or others' game video using, for example, phone cameras so as to improve their skills, to share to their social networks, or to archive for the own memory. In a real game, there are plenty of times when people are not playing. Recording the whole game would lead to significant waste of storage, viewing time, etc. People like to view or review the game in a compact way, or to share only those game highlights, e.g., those long rallies. Thus, it is highly desirable yet challenging to record and detect the rallies while remembering the scores of a sports gam game.

SUMMARY

As a new trend, more and more players are adopting new technologies into their games. For example, a variety of smart rackets/bats have emerged that can sense a user's activities. These rackets/bats typically have certain types of sensors integrated internally or attached externally. Such sensors include at least an inertial measurement unit (IMU) that has at least one accelerometer and one gyroscope. It is also possible that people wear certain types of sensors on their body (e.g., hand, wrist, forearm, etc.) during the game while using normal rackets/bats.

Embodiments of the invention provide a solution to detect one or more rallies and to compose highlights, in a sports game such as a badminton game. The solution leverages sensing data received from the sensors attached to a sports instrument (e.g., a badminton racket) to detect a time and type of user actions, such as a stroke. Based on detected timing information between consecutive strokes and the type of stroke, one embodiment of the invention determines whether there was a rally and the start and end time of the rally. Responsive to the determination of a rally, recording of the sport game is automatically triggered.

A stroke of a sports game is detected based on motion data sensed by a sensor attached to a sports instrument, such as a badminton racket. In one embodiment, a determination is made whether the detected stroke is a double hit, i.e., two consecutive strokes were from the same player or the players from the same team in a double game. If the stroke is a double hit, the current rally is determined to be completed. If the stroke is not a double hit, a determination is made whether a time elapsed since a previous stroke is larger than an upper threshold value. If the time elapsed since the previous stroke is larger than the upper threshold, a determination is made whether the stroke is a serve move. If the stroke is a serve move, a new rally is identified in the sports game and automatic recording of the sports game is activated.

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the disclosed subject matter.

The figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

System Overview

Figure 1A:
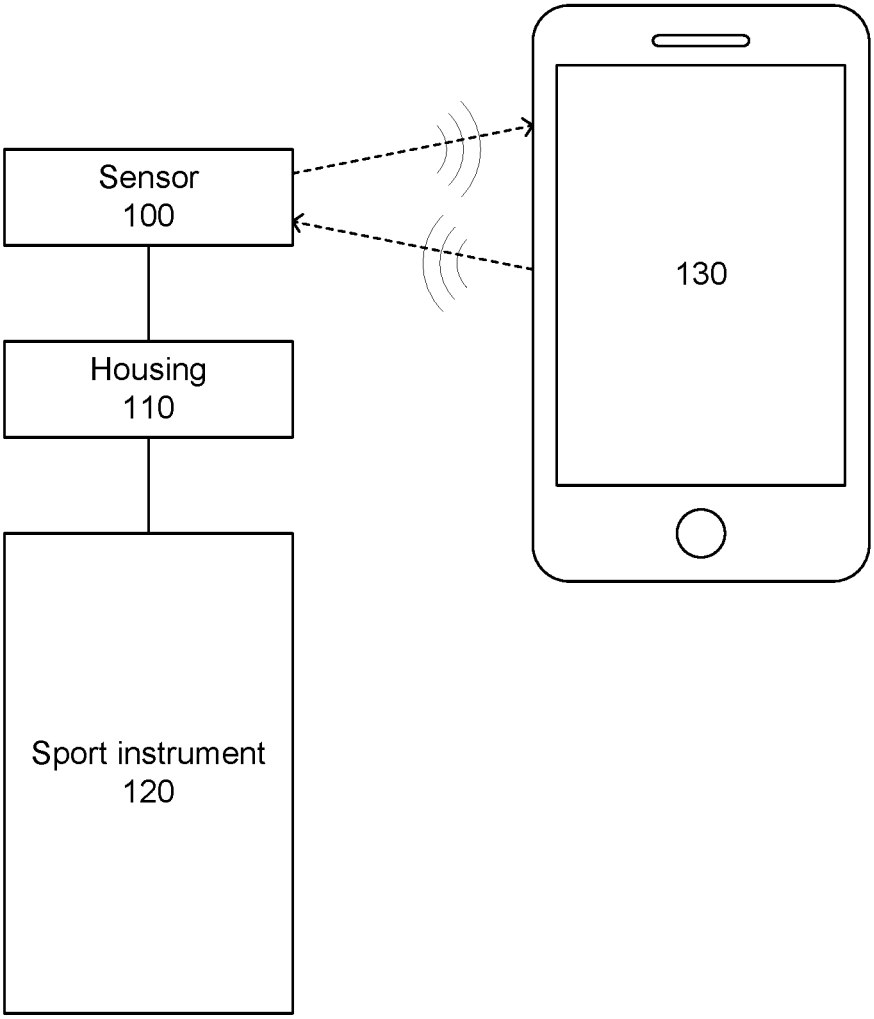
FIG. 1A illustrates a block diagram of a sensor attached to a sports instrument, according to one embodiment.

FIG. 1A illustrates a block diagram of a sensor 100 attached to a sports instrument 120, according to one embodiment. The sensor 100 includes components such as accelerometers and gyroscopes to detect and record movement of a user/player using the sport instrument 120. For instance, the sensor 100 may record movement in 6 different axes, including 3 translational axes (x-axis, y-axis, and z-axis) and 3 rotational axes (roll, pitch, and yaw). The motion parameters associated with the detected motion are collected through the embedded motion sensor and analyzed by a motion detection and recognition system. Examples of the embodiments of these motion sensors and the motion detection and recognition system include some described in U.S. Patent Publication No. 2012/0277890 A1 and U.S. Pat. No. 8,725,452 B2, each of which is incorporated by reference herein in its entirety.

As illustrated in FIG. 1A, the sensor 100 is attached to the sports instrument 120 via a housing 110. In some embodiments, the housing 100 is part of the sports instrument 120. For instance, the housing 100 may be part of the handle of the sport instrument 120. In other embodiments, the housing 100 may include a mechanism to be attached to both the sensor 100 and the sports instrument 120.

The sensor 100 that is inserted into the sports instrument 120 via a housing 110 wirelessly connects to a client device 130. The sensor 100 connects to the client device 130 via a wireless communication protocol, such as Bluetooth, Bluetooth Low Energy (BLE), Wi-Fi, LTE, ultra-wide band (UWB), etc. In some embodiments, the client device 130 is a mobile device, such as a smartphone, and the client device 130 executes a motion data analysis software program. In some embodiments, the device 100 is a motion sensor and the motion sensor 100 sends recorded motion data of a player using the sports instrument 120 to the client device 130 for further processing in real time. In other embodiments, the sensor 100 stores the recorded data in an internal memory, and sends the stored data to the client device 130 or a cloud service at a later time. The client device 130 may then be used to view the recorded data. In some embodiments, the client device 130 further analyzes the motion data received from the sensor 100 and displays the analyzed data to the user of the mobile device 130. For instance, the client device 130 may present the current score of the game based on the analyzed data received from the sensor 100.

Figure 1B:
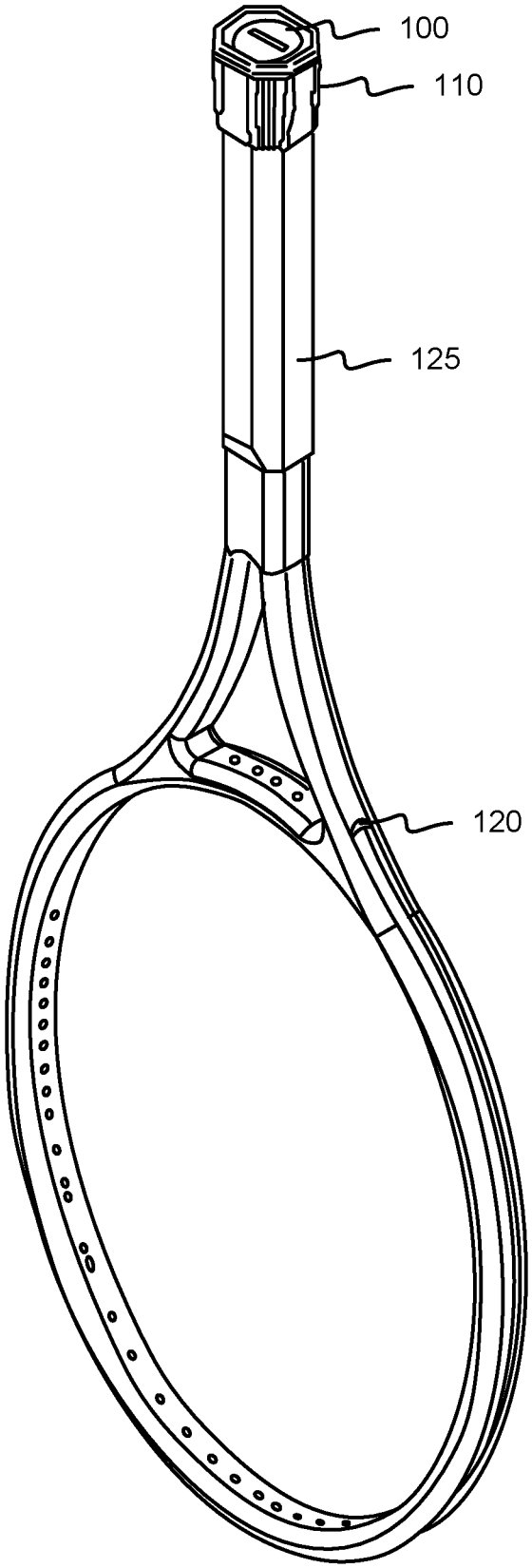
FIG. 1B illustrates a motion sensor device for insertion into a sports instrument and a sports instrument having a slot for housing the motion sensor device, according to one embodiment.

FIG. 1B illustrates a motion sensor for insertion into a sports instrument and a sports instrument having a slot for housing the motion sensor, according to one embodiment. The sports instrument 120 illustrated in FIG. 1B is a tennis racket for illustration purpose, but other sports instruments may be used as well (e.g., a squash racket, a table tennis paddle, or a badminton racket). The sports instrument 120 includes a handle 125 for a user to hold the sports instrument 120. The handle 125 of the sports instrument 120 includes a housing 110 for housing a motion sensor 100. In some embodiments, the motion sensor 100 is detachable from the housing 110. Additionally, the housing 110 may also be detachable from the handle 125 of the sports instrument 120. In this embodiment, the housing 110 may have a first opening for inserting the motion sensor device 100 into, and a second opening attaching the housing 110 to the handle 125 of the sports instrument 110.

Figure 1C:
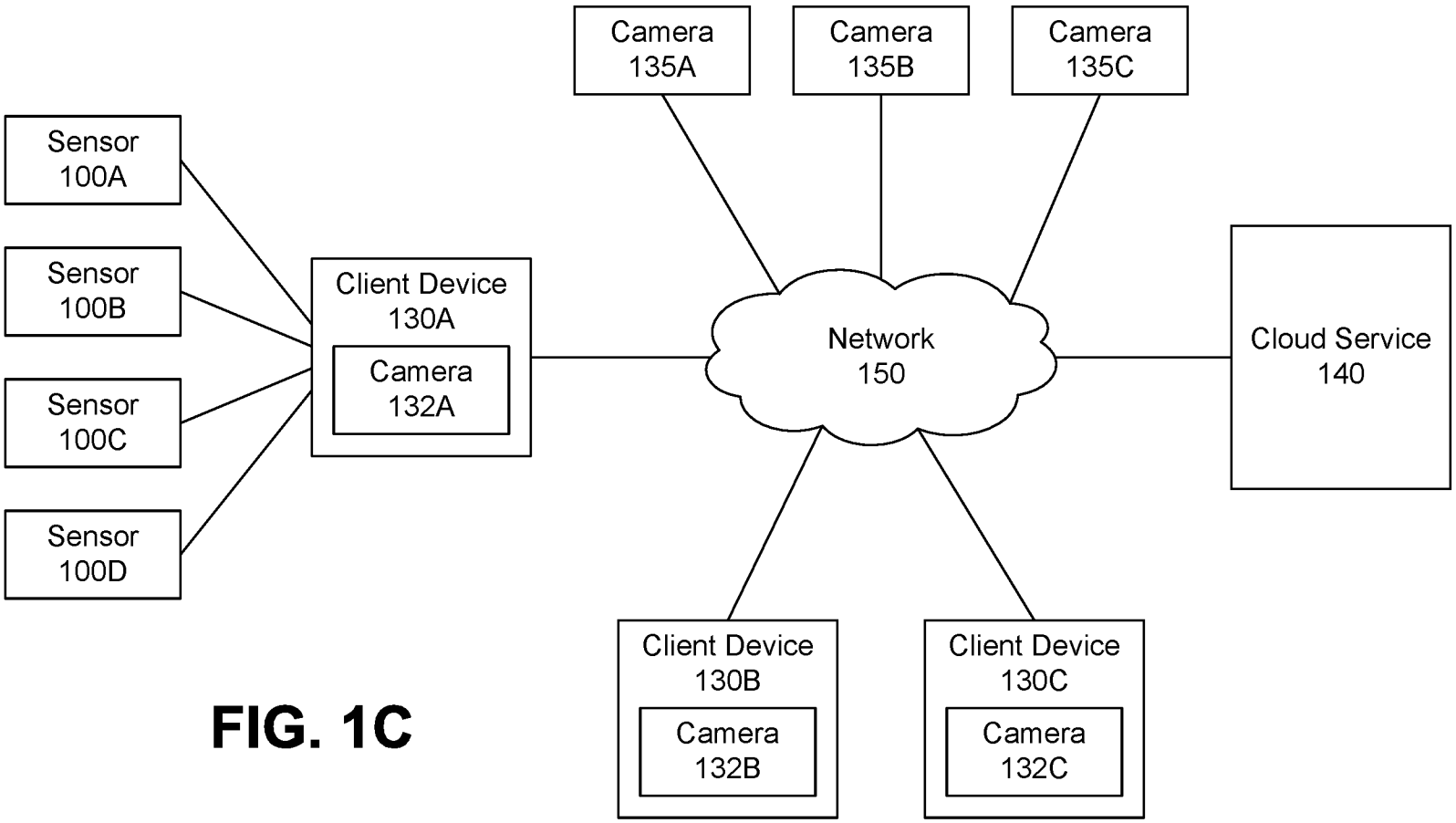
FIG. 1C illustrates a system architecture for tracking the performance of a sports game, according to one embodiment.

FIG. 1C illustrates a system architecture for tracking the performance of a sports game, according to one embodiment. The system architecture includes multiple client devices 130 (e.g., 130A, 130B, and 130C). A client device 130 is an electronic device used by a user to perform functions such as consuming digital content, executing software applications, browsing websites, downloading files, and the like. For example, the client device 130 may be a media streaming device, a smart phone, or a tablet, notebook, or desktop computer. The client device 130 includes and/or interfaces with a display device on which the user may view videos and other content. In addition, the client device 130 provides a user interface (UI), such as physical and/or on-screen buttons, with which the user may interact with the client device 130 to perform functions such as viewing, selecting, and consuming digital content such as sports instructional videos.

At least one of the client devices 130A is coupled to one or more sensors 100. In the embodiment of FIG. 1C, client device 130A is used by a player of a sports game and is coupled to four sensors 100A, 100B, 100C, and 100D. The client devices 130B and 130C may be used by other player(s) or by audiences of the sports game to take pictures or record videos of the sports game. For instance, each of the sensors 100A through 100D is attached to a racket of a player of a doubles match of a badminton game. As such, each of the sensors 100A through 100D detects and records movement of the sport instrument 120 used by their respective player and sends the recorded data to the client device 130A.

In one embodiment, each of the sensors 100 is configured to send back a portion of the detected motion data of its corresponding sport instrument 120, which are determined informative or relevant for detecting rallies in a sports game. The sensor 100 may be further configured to filter the detected motion data and send back filtered motion data to the client device 130 or the cloud service 140. In one embodiment, the sensor attached to the sports instrument is triggered to collect and send data back upon an activation event or a triggering mechanism. Taking a motion sensor attached to a badminton racket as an example, the motion sensor is triggered to record its user's actions responsive to the racket's vibration (e.g. when hitting a shuttlecock) exceeding certain a threshold.

In some embodiments, one or more client devices 130 have a built in camera 132. The system architecture for tracking the performance of a sports game may further include one or more cameras 135 inside the venue of the sports game. For instance, cameras 135 may include cameras fixed to the walls or ceiling of the venue at which the sports game is being played. Built in cameras 132 and cameras 135 are used to record motion data of the sports game.

Each of the client devices 130 and cameras 135 are connected to a cloud service 140 via a network 150. The network 150 enables communications among the client device 130, cameras 135, and the cloud service 140. In one embodiment, the network 150 comprises the Internet and uses standard communications technologies and/or protocols. In another embodiment, the entities can use custom and/or dedicated data communications technologies.

The cloud service 140 receives videos recorded by the one or more client devices 130 and the one or more cameras 135 and archive the game video and/or generates a highlights video based on the received videos. As used herein, a highlight video is a video containing one or more rallies or portions of one or more rallies. In some embodiments, the cloud service 140 additionally receives motion data detected by the one or more sensors 100, and selects portions of the received videos based on the received motion data for generating highlight reels of a video of the sports game. As used herein, a highlight reel is a video containing multiple highlight video of a game. In some embodiments, certain functions described herein as being performed by a client device 100 is instead performed by the cloud service 140.

In this disclosure, "video content," "digital content" or "digital media content" generally refers to any machine-readable and machine-storable work. Digital content can include, for example, video, audio or a combination of video and audio. Alternatively, digital content may be a still image, such as a JPEG or GIF file or a text file. For purposes of simplicity and the description of one embodiment, the digital content will be referred to as a "video," "video files," or "video footages," but no limitation on the type of digital content that can be analyzed are intended by this terminology.

In some embodiments, the cloud service 140 may further rank rallies according to various metrics. The various metrics used to rank rallies may be based on the plurality of features of each of the strokes of the rallies. The ranking may be comprehensive by considering multiple features, or specific, i.e., considering only specific user specified features. In one embodiment, rallies are ranked according to the average racket speed of the rally, the maximum racket speed of the rally, the percentage of sweet-spot hitting, the number of strokes of the rally, etc. Highlight reels may be composed by selecting top ranked rallies within a time budget. In some embodiments, other rallies are automatically included as well, including the first winning rally, those rallies marked as favorites, the last winning rally, etc.

Computing System Architecture

Figure 2:
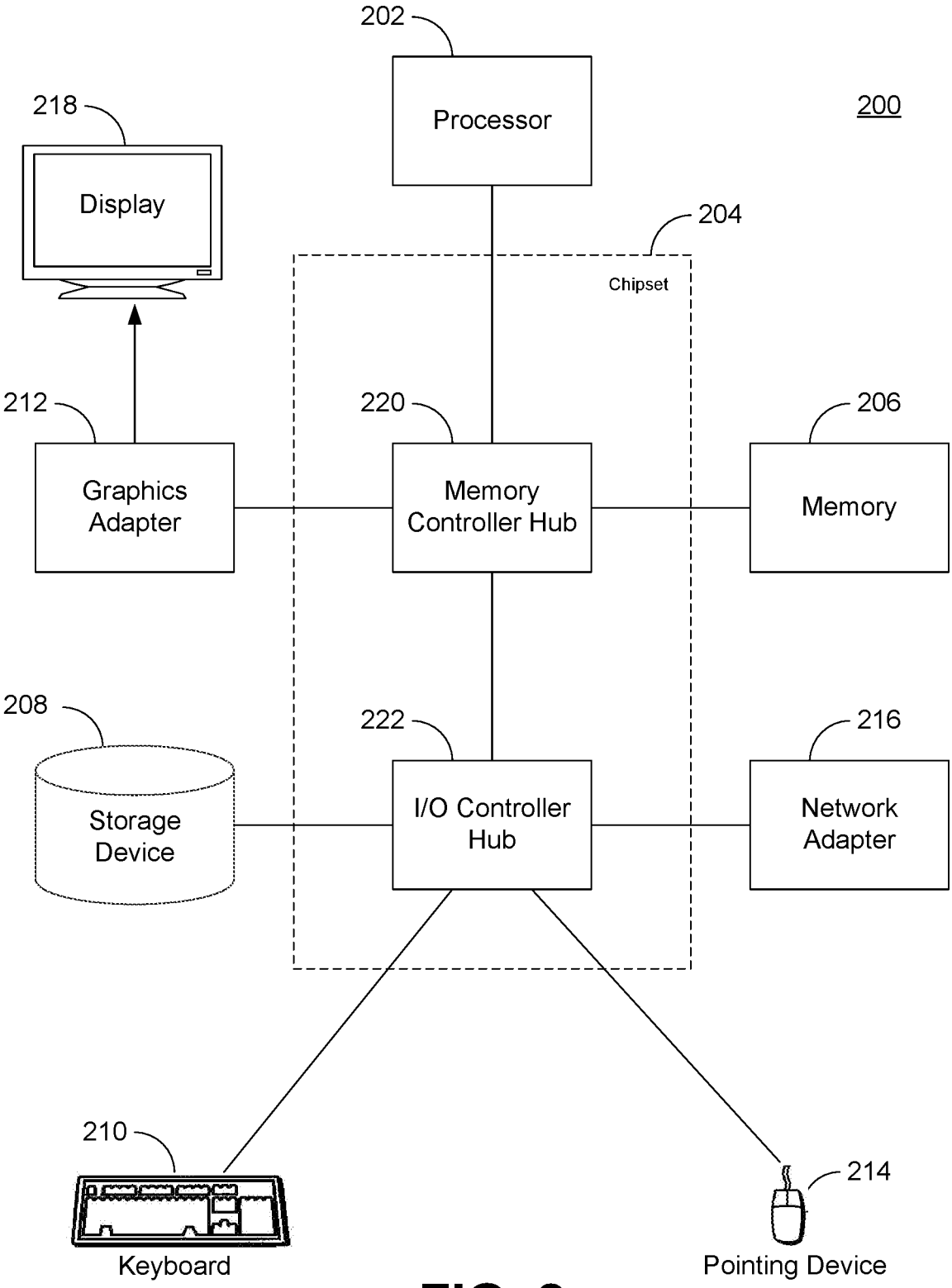
FIG. 2 illustrates a block diagram illustrating an example of a computer acting as a video sharing service and/or a client device, according to one embodiment.

The entities shown in FIG. 1A-FIG. 1C are implemented using one or more computers. FIG. 2 is a high-level block diagram of a computer 200 for acting as the cloud service 140 and/or a client device 130, according to one embodiment. Illustrated are at least one processor 202 coupled to a chipset 204. Also coupled to the chipset 204 are a memory 206, a storage device 208, a keyboard 210, a graphics adapter 212, a pointing device 214, and a network adapter 216. A display 218 is coupled to the graphics adapter 212. In one embodiment, the functionality of the chipset 204 is provided by a memory controller hub 220 and an I/O controller hub 222. In another embodiment, the memory 206 is coupled directly to the processor 202 instead of the chipset 204.

The storage device 208 is any non-transitory computer-readable storage medium, such as a hard drive, compact disk read-only memory (CD-ROM), DVD, or a solid-state memory device. The memory 206 holds instructions and data used by the processor 202. The pointing device 214 may be a mouse, track ball, or other type of pointing device, and is used in combination with the keyboard 210 to input data into the computer system 200. The graphics adapter 212 displays images and other information on the display 218. The network adapter 216 couples the computer system 200 to the network 150.

As is known in the art, a computer 200 can have different and/or other components than those shown in FIG. 2. In addition, the computer 200 can lack certain illustrated components. For example, the computers acting as the cloud service 140 can be formed of multiple blade servers linked together into one or more distributed systems and lack components such as keyboards and displays. Moreover, the storage device 208 can be local and/or remote from the computer 200 (such as embodied within a storage area network (SAN)).

As is known in the art, the computer 200 is adapted to execute computer program modules for providing functionality described herein. As used herein, the term "module" refers to computer program logic utilized to provide the specified functionality. Thus, a module can be implemented in hardware, firmware, and/or software. In one embodiment, program modules are stored on the storage device 208, loaded into the memory 206, and executed by the processor 202.

Automatic Rally Detection and Scoring

Figure 3B:
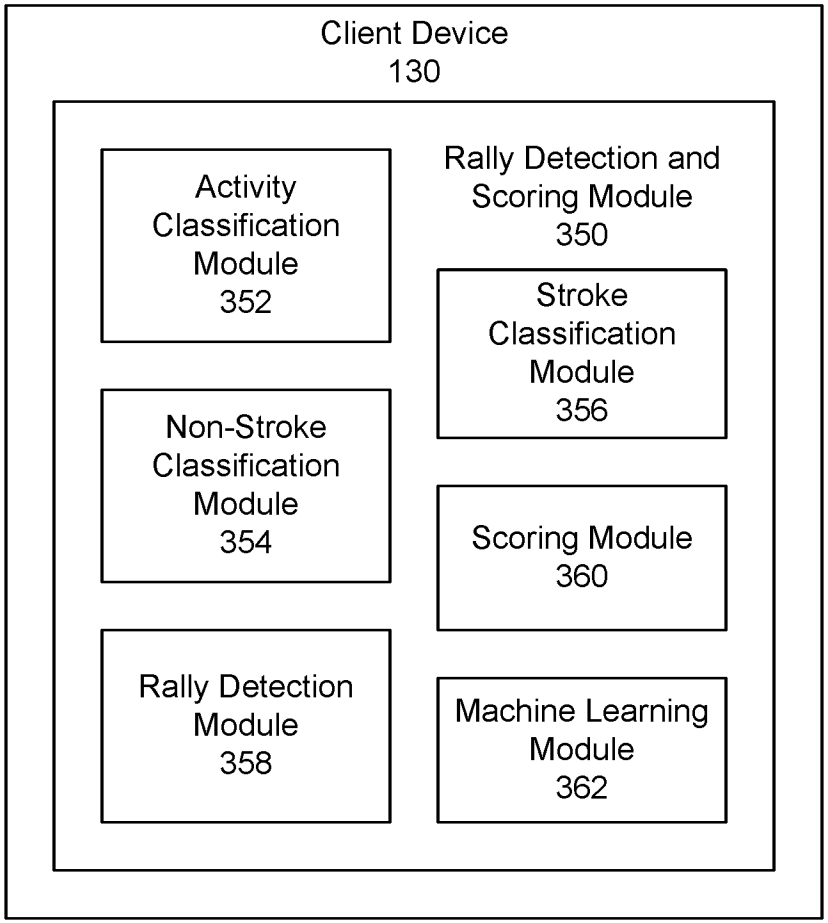
FIG. 3B illustrates a block diagram of a client device having a rally detection and scoring module, according to one embodiment.
Figure 3A:
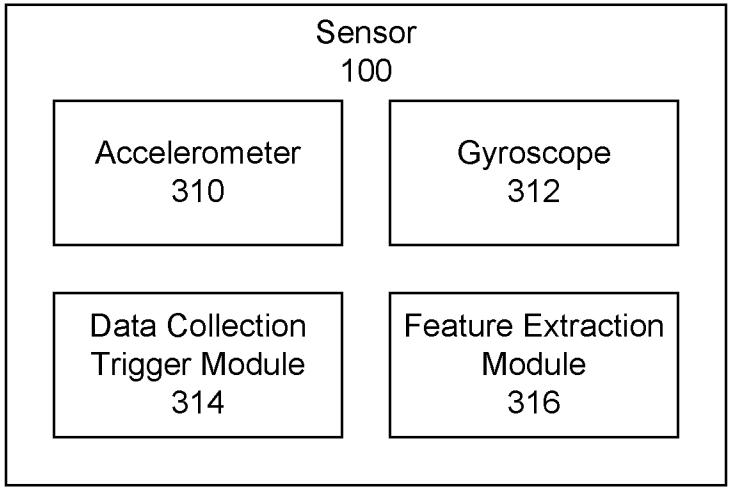
FIG. 3A illustrates a block diagram of a sensor used by sports instruments, according to one embodiment.

FIG. 3A illustrates a block diagram of a sensor 100, according to one embodiment. The sensor 100 includes an accelerometer 310, a gyroscope 312, a data collection trigger module 314, and a feature extraction module 316. The accelerometer 310 detects and measures an acceleration of a sports instrument to which the sensor 100 is attached. The accelerometer 310 detects and measures acceleration in three different axes (up & down, left & right, and forward & backward). In some embodiments, the accelerometer 310 is a piezoelectric accelerometer. In other embodiments, the accelerometer 310 is a micro electro-mechanical systems (MEMS) accelerometer.

The gyroscope 312 detects and measures a rotation of the sports instrument to which the sensor 100 is attached. The gyroscope 312 detects and measures rotation around three different axes (pitch, yaw, and roll). In some embodiments, the gyroscope 312 is a MEMS gyroscope. In other embodiments, other types of gyroscopes may be used. In some embodiments, the accelerometer 310 and the gyroscope 312 are packaged in a single inertial measurement unit that detects and measures movement with six degrees of freedom.

The data collection trigger module 314 detects certain events based on data received from the accelerometer 310 and the gyroscope 312 and starts recording motion data based on the detection. In some embodiments, the data collection trigger module 314 detects a "hit" (e.g., a ball hitting a table tennis racket or a shuttlecock hitting a badminton racket) and records acceleration data from the accelerometer 310 and rotational data from the gyroscope 312 a preset amount of time before and after the "hit" was detected.

To detect a "hit," the acceleration data measured by the accelerometer 310 and the rotational data measured by the gyroscope 312 are optionally filtered using a low pass filter (LPF). In some embodiments, the LPF is a finite impulse response (FIR) filter. The data collection trigger module 314 then identifies abrupt changes in the filtered data. In some embodiments, the data collection trigger module 314 uses a running window to identify a hit. For each data sample in the window, an element-wise difference is determined. That is, for every acceleration and rotation measurement within the window, a difference between the measurement and a next measurement is determined. The determined element-wise differences are compared to a first threshold value (e.g., an acceleration threshold th_acc for acceleration measurements and a rotational threshold th_gyro for rotational measurements). In some embodiments, the first threshold value may be dynamic (e.g., adapted to the actual strength of user swings) and be different for each acceleration or rotational measurement. If the number of element-wise differences within the window that are larger than the first threshold value is larger than a second threshold value th_win, a hit is detected. In some embodiments, the data collection trigger module 314 detects a "hit" if at least a third threshold number of consecutive hit windows are detected.

In other embodiments, the data trigger module 314 first initializes a first counter to zero and determines an element-wise difference for the data measured by the accelerometer 310 and the gyroscope 312. Each time the element-wise difference is larger than the first threshold, the first counter is incremented. If the first counter passes the second threshold value, a second counter is incremented, running window is moved forward (e.g. by one or more data samples), and the first counter is initialized back to zero. Otherwise, if the first counter does not exceed the second threshold value by the end of the running window, the running window is moved forward, and the first and second counters are initialized back to zero. Finally, if the second counter passes the third threshold, a hit is detected.

The feature extraction module 316 extracts features from the recorded acceleration and rotational measurements. In some embodiments, the feature extraction module 316 downsamples the filtered recorded data, e.g., uniformly filtered. For example, in a typical stroke, the detected motion signals are relatively smooth before an impact point, changes abruptly (e.g., oscillate significantly) immediately after the impact point, and become smooth again after a short while. One way of extracting features in this scenario is to uniformly downsample the filtered raw motion sensor signals. In other embodiments, the data is downsampled so that the downsampled data has a higher density for a certain length after the detection of a hit. The extracted feature data, e.g., speed, impact position, the length of oscillating period and the oscillating pattern, are used for stroke analysis. In addition, around a hit, certain or all axes of the sensor may get saturated. As such, the feature extraction module 316 may further include the number of saturating samples in the feature data.

FIG. 3B illustrates a block diagram of a client device 130 having a rally detection and scoring module 350, according to one embodiment. The rally detection and scoring module 350 of the client device 130 includes an activity classification module 352, a non-stroke classification module 354, a stroke classification module 356, a rally detection module 358, a scoring module 360, and a machine learning module 362.

In one embodiment, the machine learning module 362 trains a model for one or more of the other modules of the rally detection and scoring module 350 using machine learning schemes on various types of training data, e.g., user/player actions using sports instruments captured during various sports games. For example, as a part of training a machine learned classification model for activity classification module 352, the machine learning module 362 forms a training set of motion data by identifying a positive training set of motion data that have been determined to be stroke move, and all other types of data as negative training set. To train a model for the non-stroke classification module 354, the machine learning module 362 forms a positive training set of motion data that have been determined to be intentional user actions (such as tap on racket face or frame) and uses other type of data caused by other random user activities as negative training set. The non-stroke classification module 354 uses a model trained from these training sets to classify activities as intentional user actions and random actions.

The machine learning module 362 extracts feature values from the training data of the training set, the features being variables deemed potentially relevant to whether or not the training data have the associated property or properties, such as features associated with a stroke and features associated with non-stroke. Specifically, the feature values extracted by the machine learning module 362 include features associated with predefined events e.g., timestamps of strokes, types of stroke (e.g. serve, play or non-play). The extracted features for a stroke or a non-stroke can be ordered in a form of feature vector.

The machine learning module 362 uses supervised machine learning to train a model, with the feature vectors of the positive training set and the negative training set serving as the inputs. Different machine learning techniques—such as linear or nonlinear support vector machine (linear SVM), boosting for other algorithms (e.g., AdaBoost), neural networks, logistic regression, naïve Bayes, memory-based learning, random forests, bagged trees, decision trees, boosted trees, or boosted stumps—may be used in different embodiments. The trained model, when applied to the feature vector extracted from motion data associated with user actions captured during a sports game, outputs an estimation of a likelihood that a desired event has occurred, e.g., a "stroke" or a "tap".

The activity classification module 352 classifies user actions in a sports game as a stroke move or a non-stroke move based on the motion data received from the sensor 100. In some embodiments, the activity classification module 352 uses a machine learned classification model to classify a user action as a stroke move or a non-stroke move. For instance, a support vector machine (SVM) model that was trained using a variety of strokes is used to classify an activity as a stroke or a non-stroke.

The non-stroke classification module 354 classifies user actions in a sports game as intentional user actions based on the motion data received from the sensor 100. The non-stroke classification module 354 detects a variety of types of special user actions, such as tapping on the face (or the frame) of the racket, rotate the racket, or using the racket to perform certain gestures such as drawing a "cross" or a "circle" in the air. It is noted that special user actions and certain gestures are often happening immediately before or after a "hit." Non-stroke actions that fail to be classified as a special user action are discarded as noises.

The non-stroke classification module 354 may further determine whether the non-stroke move of a special user action was an intentional activity and what the user's intention represented by the corresponding special user action. A special user action may be performed by a user in some patterns, e.g., perform the same action twice or triple times in a short interval; a mixture of different special user actions is allowed to be recorded. In one embodiment, some consecutive special user actions following certain patterns form intentional activities. The intentional special user actions are used in tasks such as rally detection, auto scoring modification, and highlight generation. In some embodiments, a user may register customized user specific non-stroke actions with the rally detection and scoring module 350, where the user can personalize the mapping between a special user action, e.g., tapping twice on the face of the racket, and user's intention, e.g., marking a rally as favorite.

The stroke classification module 356 classifies stroke moves into one or more classes, such as serve, play, or non-play strokes. For example, for badminton, a stroke move can be serve, high clear, drop, or smash; for tennis, a stroke move can be serve, topspin, slice, smash, volley, or the like. A serve stroke is a stroke performed at the beginning of a rally. A play stroke is a stroke performed during a rally after a player has already served. Examples of play strokes include clear, drive, lift, drop, smash, and net shot. A non-play stroke is a stroke that is performed outside of a rally. Examples of non-play strokes include pick, receive, and pass. In addition to determining a stroke type, the stroke classification module 356 may determine other properties of the strokes, such as, speed, impact position (i.e., which part of the racket face is hit), framehit (i.e., hit on the frame of the racket), whether the stroke was a forehand or a backhand swing, etc.

In one embodiment, to classify the stroke moves, the stroke classification module 356 uses a machine learned classification model trained by the machine learning module 362. It is noted that a user action of a stroke can be separated into 4 stages: the backswing, the foreswing, hit or impact and swing through. In badminton, the foreswing may also include a portion of player action caused by the finger actions of the player. In certain strokes, e.g., a block stroke in badminton or a volley in tennis, some stages of the stroke can be very short. For example, both a decision tree and a multiclass SVM may be used to classify stroke moves based on training data. For example, for badminton, the stroke classification module 356 uses a model trained with a SVM scheme on all types of strokes, where the racket actually interacts with the shuttlecock, such as the player using his/her racket to pick up the shuttlecock from the ground or receiving the shuttlecock passed by another player.

In another embodiment, a correlation-based detection is used to classify the stroke moves. The training data include a lots of sample strokes for each type; a dynamic time warping (DTW) is used to align strokes in the same category; all sample strokes in the same category can be averaged to obtain a representative stroke of the type. At runtime, the DTW is applied to an input stroke against the representative strokes of all known types. The type with the highest score is assigned to the input stroke under the test.

In some embodiments, the stroke classification module 356 uses a context-aware classifier, where a variety of contexts, for example, the time interval between consecutive strokes are leveraged to aid the classification task. In one embodiment, the stroke classification module 356 obtains stroke speed using a regression scheme, where the feature data including acceleration data and rotation data for a certain number of samples in a short period before the impact point, and also the number of saturating samples around the impact point.

To handle situations where a user rotates the racket between strokes, the sensor attitude may be rotated 180 degrees so that the positive direction of the y-axis accelerometer is in the forward play direction. Furthermore, to handle left and right handed players, the stroke detection may be performed to the data and a flipped version of the data since there is a high level of symmetry between right handed and left handed strokes.

The rally detection module 358 detects a rally in a play through of a sports game. As used herein, a rally is a sequence of one or more strokes starting with a serve move. Depending on the type of the sport, the sequence of strokes may be alternating strokes from different players of the game. Usually a rally ends when a ball or a shuttlecock ceases to be in play (e.g., a ball or shuttlecock hits the ground in badminton). Depending on the type of the sport, the winner of the rally may serve for the next rally.

In some embodiments, to perform rally detection, strokes from one or more players of a game are assembled into a time series of strokes. The rally detection module 358 uses the elapsed time between consecutive strokes and the stroke type, as determined by the stroke classification module 356, to detect rallies. In some embodiments, the start and end time of a rally is used to trigger a video capture or bookmarking of a continuously recorded video.

Figure 4A:
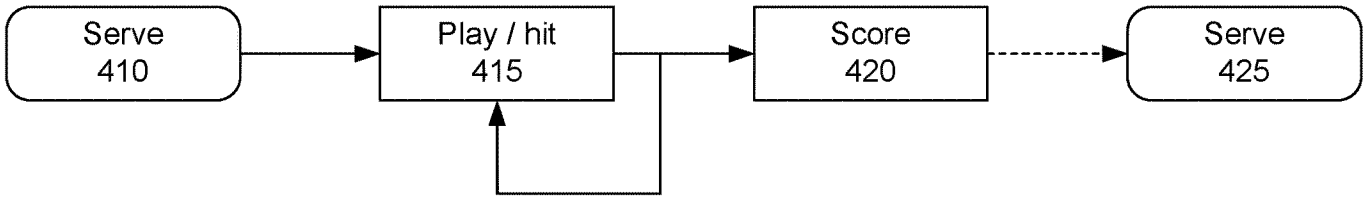
FIG. 4A illustrates a flow diagram of a rally in a game, according to one embodiment.

FIG. 4A illustrates a flow diagram of a rally in a game, according to one embodiment. The rally starts with a serve 410. After the serve 410, the rally may have one or more plays 415. In some embodiments, the rally does not include any hits after the serve 410 (e.g., an ace in a tennis game). At the end of the rally, one of the players of the game scores 420 one or more points. After the rally, the winner of the rally may serve 425 for a next rally.

Figure 4B:
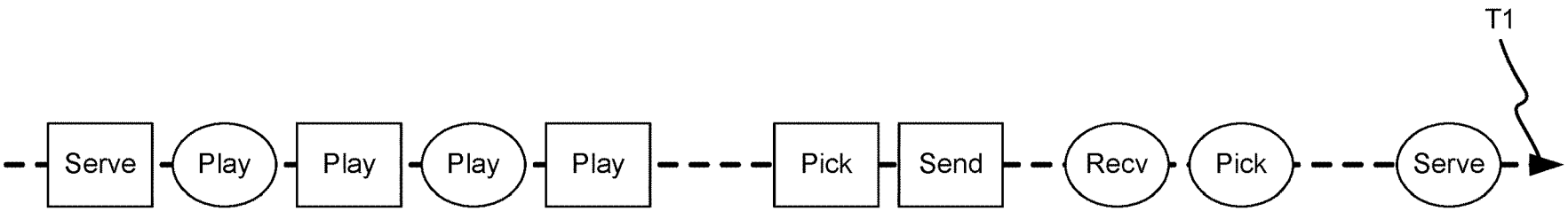
FIG. 4B illustrates a timing diagram of an example rally in a badminton game.
Figure 4B:
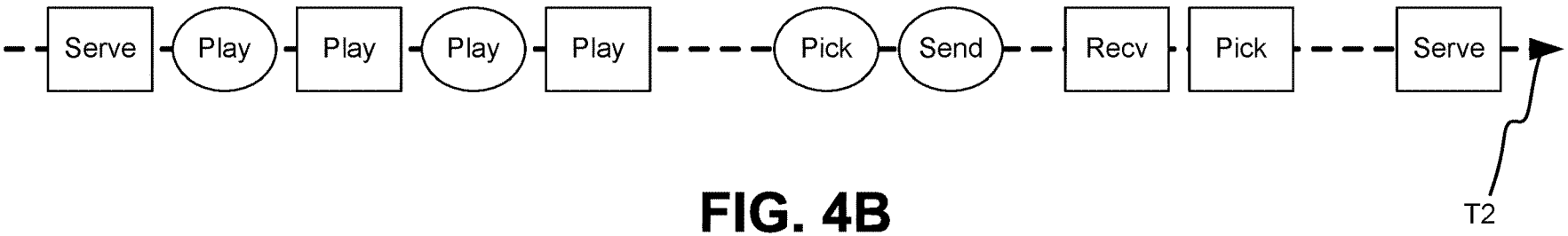

FIG. 4B illustrates general play sequence diagrams of rallies in a game, according to one embodiment. In the play sequence diagrams of FIG. 4B, a square represents a first player (player A) and an oval represents a second player (player B). At the beginning of the first sequence diagram, player A serves, starting a first rally. After the serve from player A, player B and player A alternately plays. After a play from player B, there may be a long interval without any strokes from any of the players. After the long interval, player A picks the shuttlecock and sends the shuttlecock to player B. Player B receives and picks the shuttlecock sent by player A. After player B picks the shuttlecock, player B serves, starting a second rally. Since player B served in the second rally, player B scored a point in the first rally.

At the beginning of the second sequence diagram, player A serves, starting a first rally. After the serve from player A, player B and player A alternately plays. After a play from player B, there is a long interval without any strokes from any of the players. After the long interval, player B picks the shuttlecock and sends the shuttlecock to player A. Player A receives and picks the shuttlecock sent by player B. After player A picks the shuttlecock, player A serves, starting a second new rally. Since player A served in the second rally, player A scored a point in the first rally.

The sequences shown in FIG. 4B are only two examples of the many possible sequences of a rally. For instance, the sequences of FIG. 4B show that player A is the last player to play in the rally. In other examples, player B might be the last player to play in the rally. Furthermore, in other examples, the players may not send the shuttlecock to the opponent player before a serve. That is, the player serving may pick the shuttlecock themselves instead of having the opponent player picking and sending the shuttlecock.

Returning back to FIG. 3B, the scoring module 360 automatically assigns scores to each of the players or teams playing the sports game based on the outcome of the rallies. The scoring module 360 automatically increases the score of the players of a game based on the start and end of rallies. For instance, a player that serves (i.e., starts a rally) is awarded one or more points (e.g., 15 points in a game of tennis). In some embodiments, the scoring module 360 additionally updates the scoring of the game based on detected intentional user actions. For example, a double tap on the frame of a racket may signify that the previous rally is invalid, and the scoring is updated accordingly.

Figure 5:
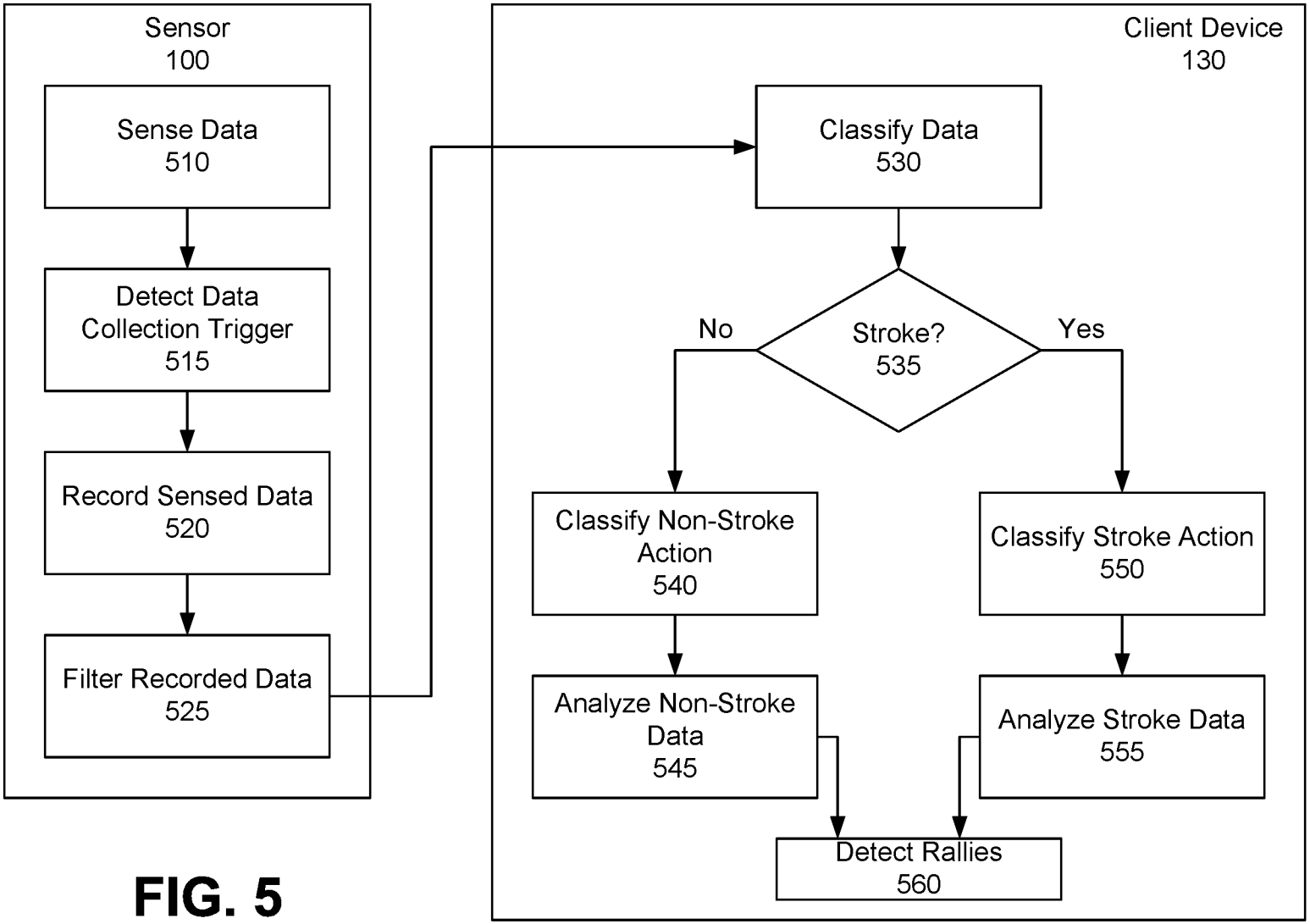
FIG. 5 illustrates a flow diagram of a method for analyzing a stroke in a sports game, according to one embodiment.

FIG. 5 illustrates a flow diagram of a method for analyzing a stroke in a sports game, according to one embodiment. To analyze a stroke in a sports game, the sensor first senses or detects 510 motion data of the sports game. The sensed motion data includes acceleration and rotational motion data of a sports instrument being used by a player. The data collection trigger module 314 detects 515 a data collection trigger event, e.g., a "hit" (e.g., a ball hitting a table tennis racket or a shuttlecock hitting a badminton racket). In response to detecting the data collection trigger event, the sensor 100 starts recording 520 the motion data associated with user actions when playing the sports game. The feature extraction module 316 filters 525 the recorded data. In some embodiments, the filtering of the recorded data includes downsampling the recorded data. In some embodiments, the filtering of the recorded data includes performing algebraic operations to the data samples. The filtered data is then sent to the client device 130.

The activity classification module 352 of the client device 130 receives the filtered data and classifies 530 the received filtered data. A determination 535 is made whether the classified data is a stroke move or a non-stroke move. If the classified data is a stroke move, the stroke classification module 356 classifies 550 the stroke move into one of stroke classes. For instance, the stroke move may be classified as a serve, a play, or a non-play stroke. After the stroke is classified, the stroke data is analyzed 555. For instance, the stroke data is analyzed to obtain the speed of the racket, to detect the impact position of the shuttlecock on the racket face, and to detect a rally by the rally detection module 358.

Figure 6:
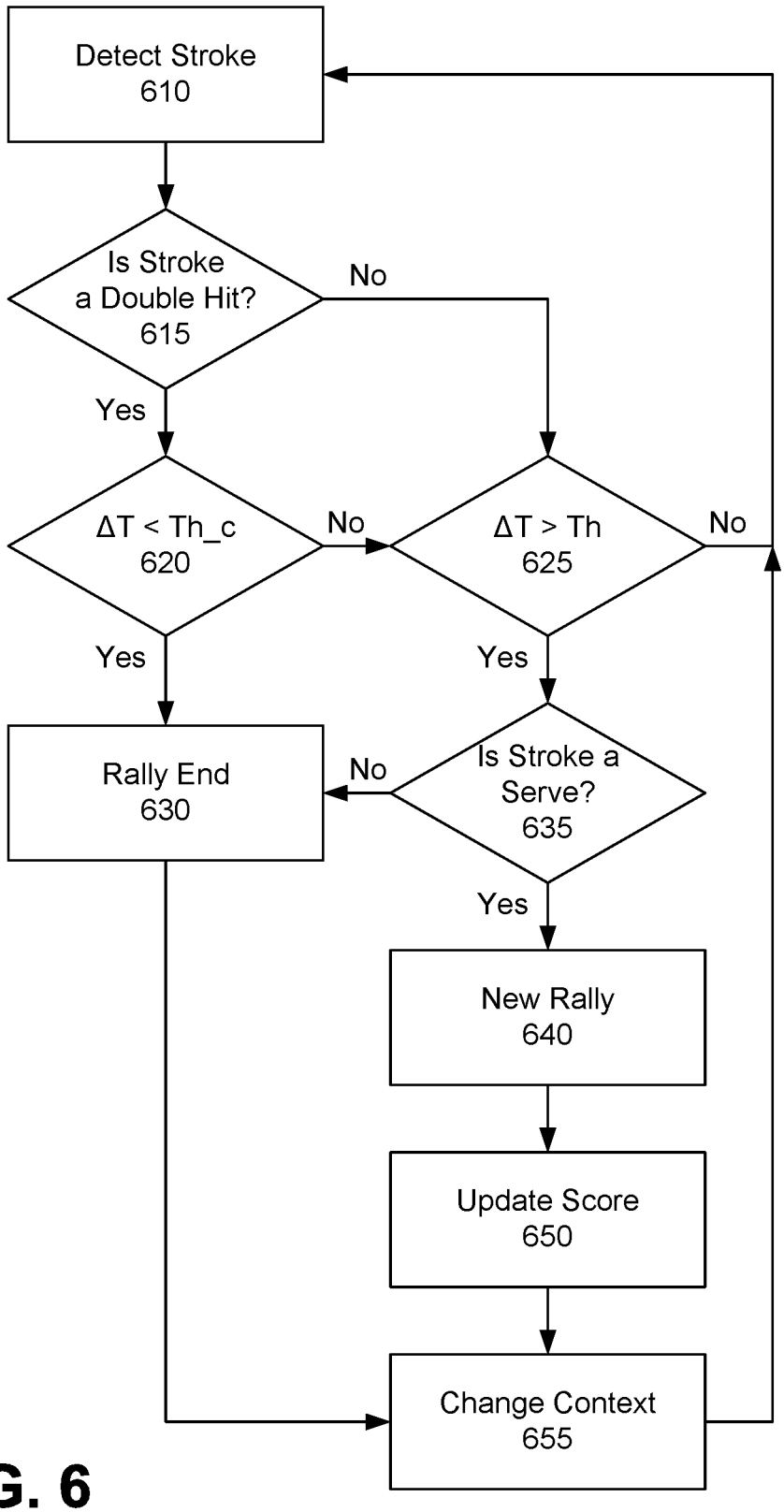
FIG. 6 illustrates a flow diagram of a method for automatically scoring a sports game, according to one embodiment.

Furthermore, the stroke data may be used to start or stop a video capture of the gameplay of the sports game. Additionally, as illustrated in FIG. 6, the stroke data may be used to automatically score the sports game. In one embodiment, the analyzed stroke data include statistics of user actions that constitute strokes, e.g., pay time, overall stroke number, the number of each type strokes, the average speed of each type of stroke, the heatmap of the impact positions, an estimated number of rallies, and an estimated number of strokes in the rally. The analyzed stroke data are used to detect rallies 560 by the rally detection module 358.

If the classified data is not a stroke move, the non-stroke classification module 354 classifies 540 the non-stroke move, and determines whether the non-stroke move is a special user action. A special user action is analyzed to determine whether the special user action is intentional. Intentional special user actions are used to detect rallies 560 by the rally detection module 560; non-intentional special user actions are marked as noises. After the non-stroke data is classified, the non-stroke data is analyzed 545. For instance, the non-stroke data may be used to modify the automatic scoring of the game, to start or stop a video capture of the game, to capture a photo, or to tag a specific point of the game for later review.

FIG. 6 illustrates a flow diagram of a method for analyzing a sports game, according to one embodiment. The activity classification module 352 and the stroke classification module 356 detects 610 a stroke from a stroke move. The rally detection module 358 determines 615 whether the stroke was a double hit. A double hit is a second consecutive stroke performed by a player or a player's teammate (depending on the game). If the stroke is a double hit, the rally detection module 358 determines 620 whether the time elapsed since a previous stroke is smaller than a first threshold, Th_c. If the time elapsed since the previous stroke is smaller than the first threshold, the rally detection module detects 630 an end of a rally.

If the stroke is not a double hit, or if the time elapsed since the previous stroke is not smaller than the first threshold, the rally detection module 358 determines 625 whether the time that elapsed since the previous stroke is larger than a second threshold, Th. If the time elapsed since the previous stroke is not larger than the second threshold, the process goes back to step 610 where a new stroke is detected.

Otherwise, if the time elapsed since the previous stroke is larger than the second threshold, the rally detection module 358 determines 635 whether the stroke is a serve stroke. If the serve is not a serve stroke, the rally detection module detects 630 an end of a rally. After an end of the rally and before the start of a new rally, the context is different from the inside of a rally. For example, a serve is only possible at the beginning of a rally. Thus, a detection of a serve should indicate the start of a new rally, and hence, the end of the previous rally. Thus, after an end of a rally and before the start of a new rally, a context for the context-aware stroke type detection is changed 655, e.g., changing from serve to play.

If the stroke is a serve stroke, the rally detection module 358 detects 640 a new rally. Based on the detected new rally, the scoring of the game is updated 650. In some embodiments, the client device 130 may indicate that the score of the game has been updated by playing a sound or a tone, or by flashing a light pattern. In one embodiment, the client device 130 may use different sounds or tones depending on the player or team to which the latest point has been awarded. Finally, the context for the context-aware stroke type detection is changed 655, and the process returns to step 610 where a new stroke is detected.

Figure 7A:
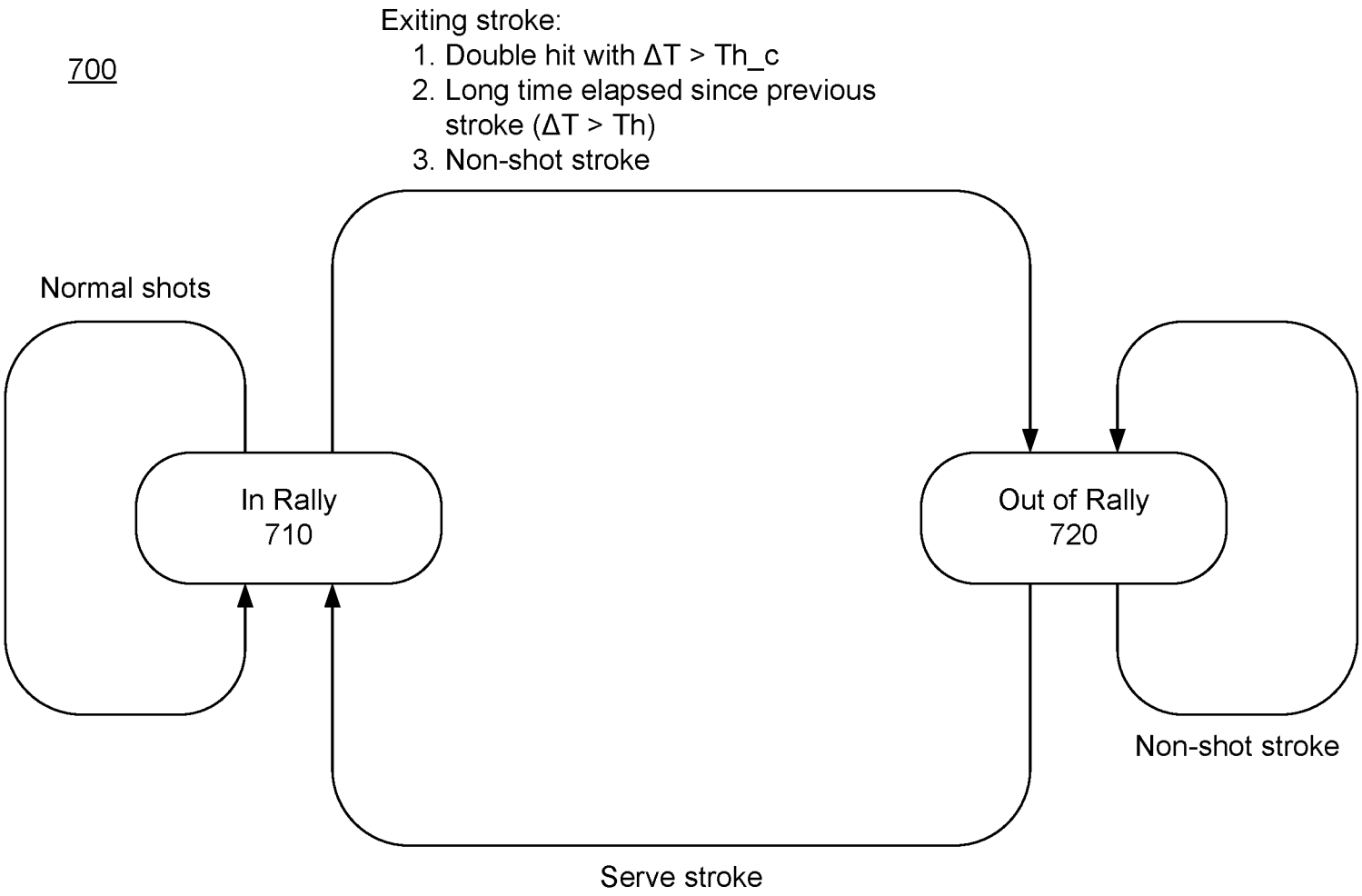
FIG. 7A illustrates a finite state machine with an "in rally" state and a "out of rally" state, according to one embodiment.
Figure 7B:
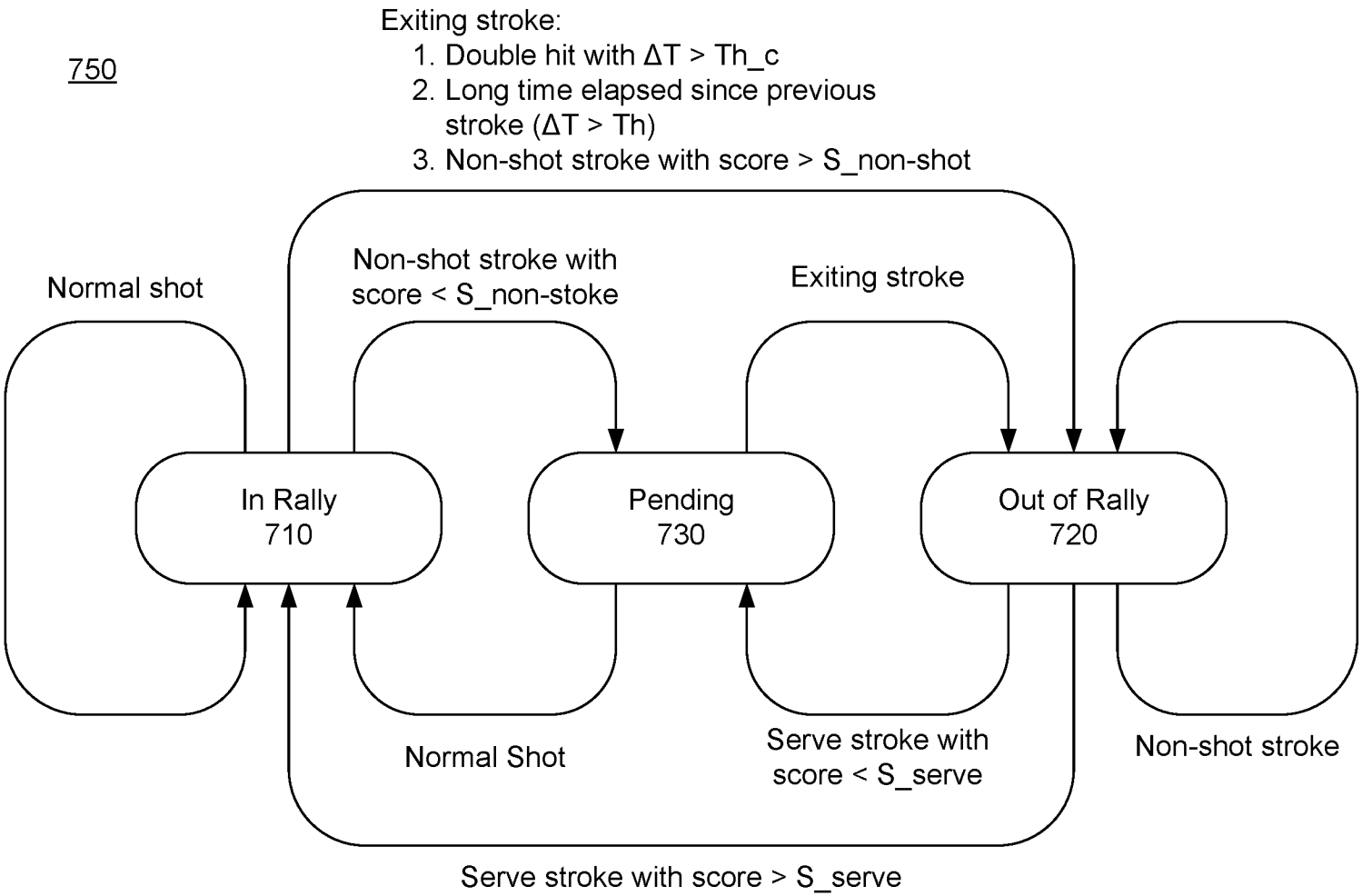
FIG. 7B illustrates a finite state machine with an "in rally" state, a "out of rally state, and a "pending" state, according to one embodiment.

FIG. 7A illustrates a finite state machine 700 with two states "in rally" 710 and "out of rally" 720 and corresponding entering/exiting state conditions. FIG. 7B further illustrates a finite state machine 750 with an additional state "pending" 730. The addition of a "pending" state 730 is to handle situations where the certain type of strokes are soft determined. For example, when the determined stroke type has a score lower than a threshold value. In the figures, a normal shot refers to the shot whose player is alternated from the previous shot and is within certain time from the previous shot.

Referring to FIG. 7A, when the finite state machine 700 is in the "in rally" state 710, if a normal shot is detected, the finite state machine 700 transitions back to the "in rally" state 710. Otherwise, if an exiting stroke is detected (e.g., a double hit as described in steps 615 and 620 of FIG. 6, a stroke after a threshold amount of time Th, or a non-shot stroke) the finite state machine 700 transitions to the "out if rally" state 720. When the finite state machine 700 is in the "out of rally" state 720, if a non-shot stroke is detected, the finite state machine 700 transitions back to the "out of rally" state 720. Otherwise, if a serve stroke is detected, the finite state machine 700 transitions to the "in rally" state 710.

Referring now to FIG. 7B, when the finite state machine 750 is in the "in rally" state 710, if a normal shot is detected, the finite state machine 750 transitions back to the "in rally" state 710. Additionally, if a non-shot stroke with a score lower than a threshold value (S non-stroke) is detected, the finite state machine transitions to the "pending" state 730. Otherwise, if an exiting stroke is detected (e.g., a double hit as described in steps 615 and 620 of FIG. 6, a stroke after a threshold amount of time Th, or a non-shot stroke) the finite state machine 750 transitions to the "out if rally" state 720. When the finite state machine 750 is in the "out of rally" state 720, if a non-shot stroke is detected, the finite state machine 750 transitions back to the "out of rally" state 720. Additionally, if a serve stroke with a score lower than a threshold (S_serve) is detected, the finite state machine 750 transitions to the "pending" state 730. Otherwise, if a serve stroke is detected, the finite state machine 700 transitions to the "in rally" state 710. When the finite state machine 750 is in the "pending" state 730, if an exiting stroke is detected, the finite state machine 750 transitions to the "out of rally" state 720. Otherwise, if a normal shot is detected, the finite state machine 750 transitions to the "in rally" state 710.

Figure 8:
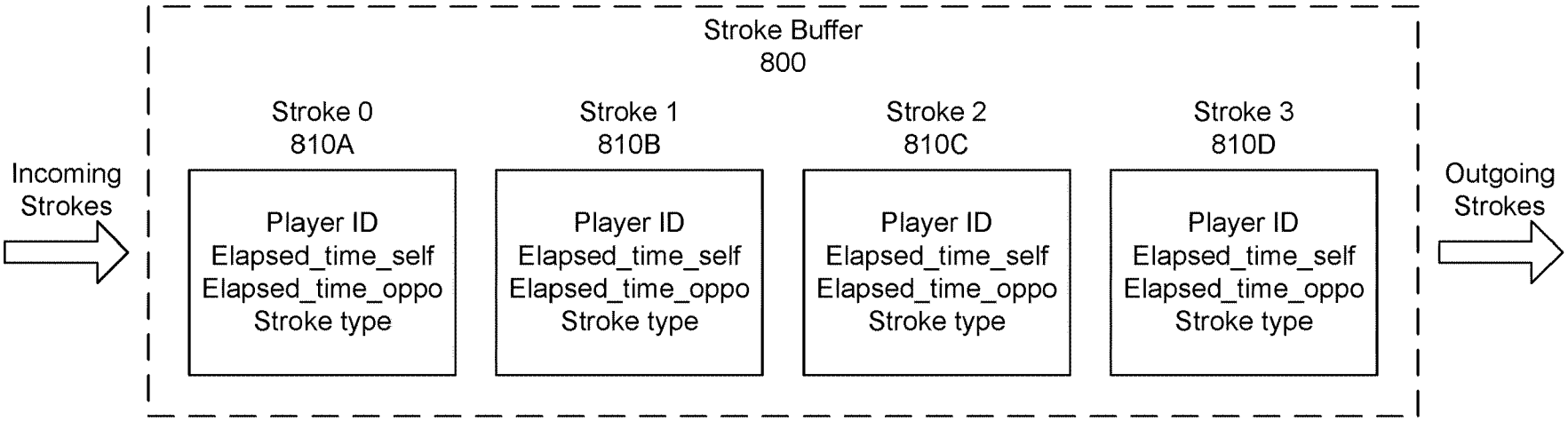
FIG. 8 illustrates a stroke buffer, according to one embodiment.

Rally detection can be carried out using a machine learning approach. Features of each stroke are determined and a buffer of three or more consecutive strokes is maintained. FIG. 8 illustrates a stroke buffer, according to one embodiment. The features of all strokes in the buffer compose the overall feature vector for rally detection and a machine learning approach is applied to determine the start and end of a rally. In one embodiment, features of a stroke include the player identification (ID), the type of stroke (e.g., a serve stroke, a pass stroke, or a normal stroke), the elapsed time of the stroke since the previous stroke from the opponent, and the elapsed time of the stroke since the previous stroke from the player himself. In some embodiment, a supporting vector machine (SVM) is used for the rally detection. Each time a new stroke is pushed into the buffer, the earliest stroke data is pushed out of the buffer, the overall feature vector is updated, and SVM is executed. For every stroke that comes in, the SVM will output an indicator if a certain stroke in the buffer is the start of a rally. In one embodiment, a four-stroke buffer is maintained and the SVM will indicate if the third stroke (i.e., stroke 2 in FIG. 8) is the start of a rally. In some embodiments, other data structures may be used to store a sequence of strokes. For instance, some embodiments may use a stack or a linked list to store the sequence of strokes.

General

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

Some portions of this description describe the embodiments of the invention in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the invention may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the invention may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

What is claimed is:

1. A computer-implemented method for detecting a rally in a sports game, the method comprising:

wirelessly receiving, at a client device, first motion data detected by a sensor attached to a sports instrument of a user during the sports game, the first motion data indicating one or more stroke actions and non-stroke actions performed using the sports instrument;

classifying, at the client device, each detected stroke action into one of a plurality of classes using a trained stroke classification model, each detected stroke having a plurality of features;

determining, at the client device, that at least some of the detected non-stroke actions are intentional special user actions according to a customized set of definitions defining one or more special user actions;

detecting, using a stroke buffer at the client device, a rally of the sports game based on the classified stroke actions and the intentional special user actions, the rally comprising a sequence of one or more strokes detected during the sports game, wherein detecting the rally of the sports game includes:

responsive to detecting the one or more strokes, determining that the stroke buffer is full;

responsive to determining that the stroke buffer is full, deleting a first stroke action stored in the stroke buffer; and responsive to deleting the first stroke action stored in the stroke buffer:

storing a new stroke action of the one or more strokes in the stroke buffer; and responsive to storing the new stroke action in the stroke buffer, applying a trained machine learning model to at least some stroke actions stored in the stroke buffer to determine a rally state indicative of the rally;

responsive to detecting the rally of the sports game, causing the sensor attached to the sports instrument to record second motion data associated with the rally, wherein the second motion data is wirelessly transmitted to a client device; and responsive to the client device determining that the rally has ended based on the second motion data, updating, at the client device, a score of the user during the sports game based only on the second motion data.

2. The method of claim 1, wherein the sports game is badminton, and a rally in badminton comprises a sequence of a serve type of stroke indicating start of a new rally, one or alternate play type of strokes, and an end-rally type stroke indicating end of the rally.

3. The method of claim 1, wherein the detection of rallies is further performed using a finite state machine having an in-rally state and an out-of-rally state.

4. The method of claim 3, wherein the finite state machine transitions from the out-of-rally state to the in-rally state in response to detecting a serve stroke, and wherein the finite state machine transitions from the in-rally state to the out-of-rally state in response to detecting an exiting stroke.

5. The method of claim 1, wherein detecting a rally of the sports game comprises:

determining whether a detected stroke is a double hit;

responsive to determining that the stroke is not a double hit, determining whether a time elapsed since a previous stroke is larger than an upper threshold value;

responsive to determining that the time elapsed since the previous stroke is larger than the upper threshold, determining whether the stroke is a serve type stroke; and responsive to determining that the stroke is a serve type stroke, identifying a new rally in the sports game.

6. The method of claim 1, wherein detecting a rally of the sports game further comprises:

responsive to determining that a stroke is not a serve type stroke, detecting a next stroke based on further motion data sensed by the sensor attached to the sports instrument.

7. The method of claim 1, further comprising:

responsive to identifying a new rally during the sports game, using the client device for updating the score of the user during the sports game.

8. The method of claim 1, further comprising:

responsive to identifying a new rally during the sports game, changing a context of stroke type detection, the context providing information describing one or more conditions for a stroke to occur in the sports game.

9. The method of claim 1, wherein the plurality of features of a stroke comprise one or more of:

timing information of the stroke;

a speed of the stroke;

an impact position of the stroke, the impact position indicating which part of face of the sports instrument is hit;

a stage of the stroke; or a length of oscillating period associated with the stroke; and oscillating pattern of the stroke.

10. The method of claim 1, further comprising:

triggering a video capture device of a client device to start capturing the sports game in response to a triggering event generated based on the detection of rallies during the sports game.

11. The method of claim 1, further comprising:

generating, using the second motion data recorded in response to detecting rally, one or more highlights of the sports game.

12. A non-transitory computer readable medium of a client device configured to store instructions that, when executed by a processor of the client device, cause the processor to:

wirelessly receive, during the sports game, first motion data detected by a sensor attached to a sports instrument of a user, the first motion data indicating one or more stroke actions and non-stroke actions performed using the sports instrument;

classify each detected stroke action into one of a plurality of classes using a trained stroke classification model, each detected stroke having a plurality of features;

determine that at least some of the detected non-stroke actions are intentional special user actions according to a customized set of definitions defining one or more special user actions;

detect, using a stroke buffer, a rally of the sports game based on the classified stroke actions and the intentional special user actions, the rally comprising a sequence of one or more strokes detected during the sports game, wherein the instructions that, when executed by the processor, cause the processor to detect the rally of the sports game include instructions to:

responsive to a detection of the one or more strokes, determine that the stroke buffer is full;

responsive to a determination that the stroke buffer is full, delete a first stroke action stored in the stroke buffer; and responsive to a deletion of the first stroke action stored in the stroke buffer:

store a new stroke action of the one or more strokes in the stroke buffer; and responsive to a storing the new stroke action in the stroke buffer, apply a trained machine learning model to at least some stroke actions stored in the stroke buffer to determine a rally state indicative of the rally;

responsive to detecting the rally of the sports game, cause the sensor attached to the sports instrument to record second motion data associated with the rally;

wirelessly receive, during the rally, the second motion data; and responsive to determining that the rally has ended based on the second motion data, update a score of the user during the sports game based only on the second motion data, wherein the first motion data and the second motion data are wirelessly transmitted from the sensor attached to the sports instrument to the client device using a wireless connection established between the sensor and the client device.

13. The non-transitory computer readable medium of claim 12, wherein the sports game is badminton, and a rally in badminton comprises a sequence of a serve type of stroke indicating start of a new rally, one or alternate play type of strokes, and an end-rally type stroke indicating end of the rally.

14. The non-transitory computer readable medium of claim 12, wherein the instructions to detect the rally of the sports game include instructions to:

determine whether a detected stroke is a double hit;

responsive to determining that the stroke is not a double hit, determine whether a time elapsed since a previous stroke is larger than an upper threshold value;

responsive to determining that the time elapsed since the previous stroke is larger than the upper threshold, determine whether the stroke is a serve type stroke; and responsive to determining that the stroke is a serve type stroke, identify a new rally in the sports game.

15. The non-transitory computer readable medium of claim 12, wherein the instructions to detect the rally of the sports game include instructions to:

responsive to determining that a stroke is a double hit, determine whether the time elapsed since a previous stroke is smaller than a lower threshold; and responsive to determining that the time elapsed since the previous stroke is smaller than the lower threshold, identify an end of a previous rally in the sports game.

16. The non-transitory computer readable medium of claim 12, wherein the instructions to detect the rally of the sports game include instructions to:

responsive to determining that a stroke is not a serve type stroke, detect a next stroke based on further motion data sensed by the sensor attached to the sports instrument.

17. The non-transitory computer readable medium of claim 12, wherein the instructions include instructions that, when executed by the processor, cause the processor to:

responsive to identifying a new rally during the sports game, use the client device to update the score of the user during the sports game.

18. The non-transitory computer readable medium of claim 12, wherein the instructions include instructions that, when executed by the processor, cause the processor to:

responsive to identifying a new rally in the sports game, change a context of stroke type detection, the context providing information describing one or more conditions for a stroke to occur in a sports game.

19. The non-transitory computer readable medium of claim 12, wherein the plurality of features of a stroke comprise one or more of:

timing information of the stroke;

a speed of the stroke;

an impact position of the stroke, the impact position indicating which part of face of the sports instrument is hit;

a stage of the stroke; or a length of oscillating period associated with the stroke; and oscillating pattern of the stroke.

* * * * *